US005599122A

United States Patent [19]

Yu

[11] Patent Number: 5,599,122

[45] Date of Patent: Feb. 4, 1997

[54] INK CARTRIDGE SELECTION CONTROL MECHANISM OF A MULTI-INK CARTRIDGE WRITING APPARATUS

[76] Inventor: Andy Yu, No. 21-5, Chi-Chou Sub-Ward, Chu Pei City, Hsin Chu Hsien, Taiwan

[21] Appl. No.: 563,929

[22] Filed: Nov. 29, 1995

[51] Int. Cl.[6] ..... B43K 24/04; B43K 24/12

[52] U.S. Cl. ..... 401/31; 401/99

[58] Field of Search ..... 401/29, 31, 112, 401/99

[56] References Cited

U.S. PATENT DOCUMENTS 3,294,068 12/1966 Hechtle ..... 401/112 X

FOREIGN PATENT DOCUMENTS 1007806 5/1952 France ..... 401/31
1249835 11/1960 France ..... 401/31
686670 3/1965 Italy ..... 401/31
393982 11/1965 Switzerland ..... 401/31
1113434 5/1968 United Kingdom ..... 401/31

*Primary Examiner*—Steven A. Bratlie
*Attorney, Agent, or Firm*—Bacon & Thomas

[57] ABSTRACT

An ink cartridge selection control mechanism of a multi-ink cartridge writing apparatus, including a plurality of slides fixed to the ink cartridges which are slidably moved in a respective sliding slot on the barrel of the pen. A plurality of springs are mounted around the ink cartridges between the slides and a locating block inside the barrel of the pen. When one ink cartridge is moved by one slide to the extended position for writing, the rounded end of the respective slide is forced into engagement with an expanded, tapered hole at one end of the respective sliding slot to lock the respective ink cartridge in the extended position. When a second ink cartridge is moved toward the extended position, the slide of the extended ink cartridge is forced outwardly to release the extended cartridge from the locked position.

1 Claim, 2 Drawing Sheets

INK CARTRIDGE SELECTION CONTROL MECHANISM OF A MULTI-INK CARTRIDGE WRITING APPARATUS

BACKGROUND OF THE INVENTION

The present invention relates to a multi-ink cartridge writing apparatus, and relates more particularly to an ink cartridge selection control mechanism of a multi-ink cartridge writing apparatus which permits the user to easily select the ink cartridges without changing the writing position of the writing apparatus.

A variety of writing apparatus including ballpoint pens, mechanically propelled pencils, etc. have been disclosed, and have appeared on the market. These writing apparatus have only one lead or ink cartridge for writing or drawing. There are also multi-ink cartridges of different colors for selection. These multi-ink cartridge ballpoint pens commonly use a thick barrel to carry multiple ink cartridges of different colors. When shifting the ink cartridges from one to another, the user must change the holding position of the hand so that the press button at the rear end of the barrel can be operated. Conventional multi-ink cartridge ballpoint pens commonly use a rotary cartridge selection control mechanism or a sliding cartridge selection control mechanism to control the selection of the ink cartridges. The rotary cartridge selection control mechanism uses a rotary member or cam to select the desired ink cartridge, and a press button to force the selected ink cartridge out of the barrel for writing. The sliding cartridge selection control mechanism uses a plurality of press buttons installed in the rear end of the barrel for controlling the respective ink cartridges. When a specific ink cartridge is selected, the user must change the holding position of the hand so that the corresponding press button can be depressed to force the respective ink cartridge out of the barrel.

SUMMARY OF THE INVENTION

The present invention provides an ink cartridge selection control mechanism which uses a plurality of slides to move the ink cartridges of a multi-ink cartridge writing apparatus between extended positions and retracted positions so that the user can easily select the desired ink cartridge for writing without changing the holding position of the hand.

DETAILED DESCRIPTION OF THE PREFERRED EMBODIMENT

Figure 1:
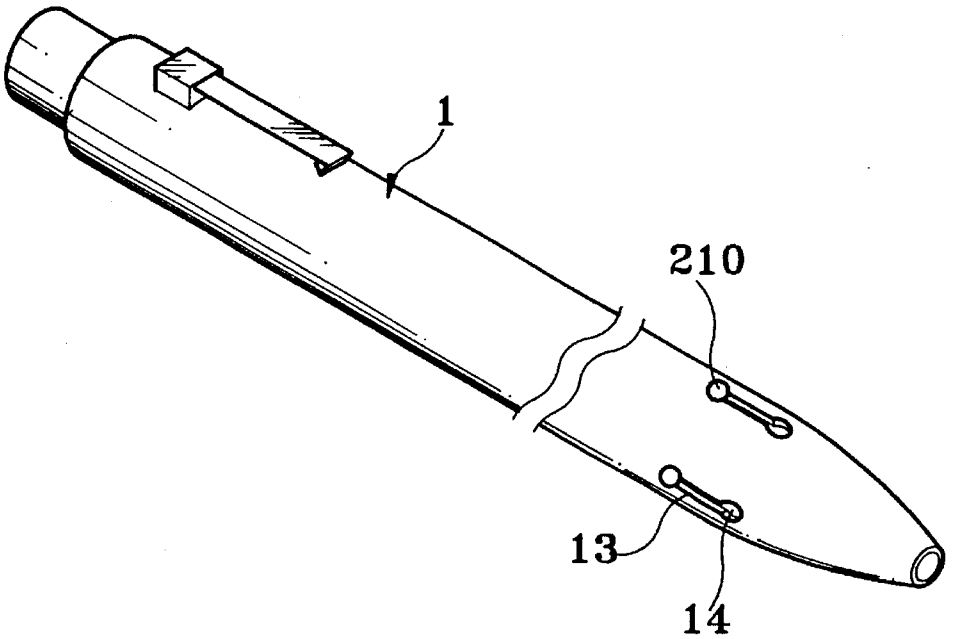
FIG. 1 is an elevational view of a multi-ink cartridge writing apparatus equipped with an ink cartridge selection control mechanism according to the present invention.
Figure 2:
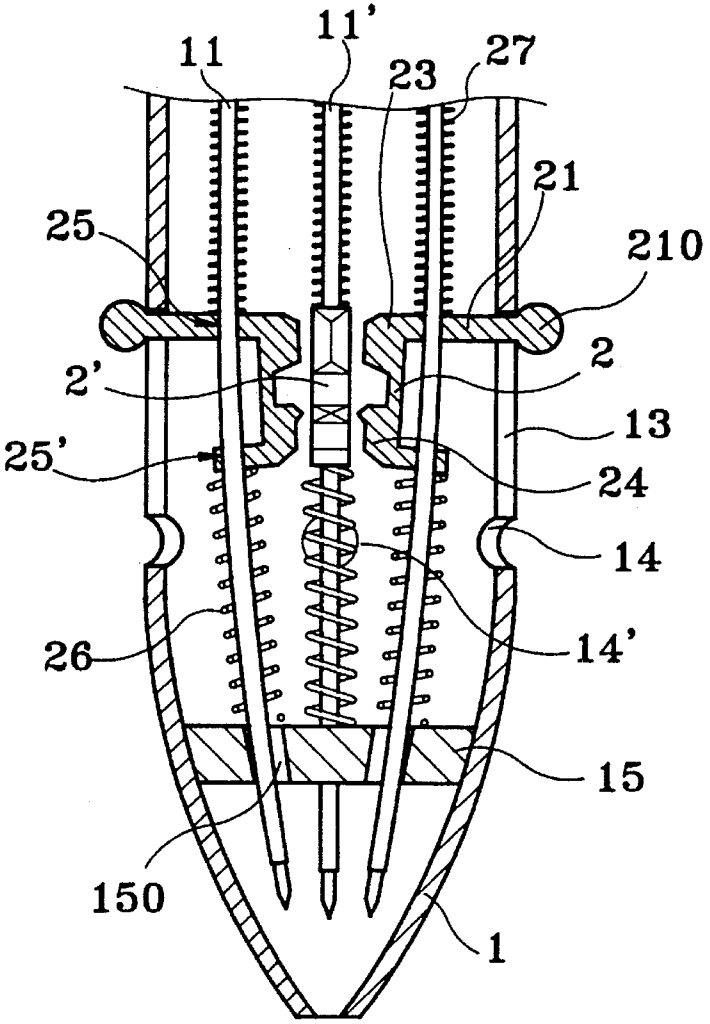
FIG. 2 is a sectional view in an enlarged scale of the front end of the multi-ink cartridge writing apparatus of FIG. 1, showing the arrangement of the ink cartridge selection control mechanism.

Referring to FIGS. 1 and 2, a plurality of ink cartridges 11 and 11' are mounted inside the barrel, referenced by 1. The ink cartridges 11 and 11' can be differently colored so that they can be distinguished from one another. Slides 2 and 2' are respectively mounted on the ink cartridges 11 and 11'. A bottom spring 26 and an upper spring 27 are respectively connected to the two opposite sides of each of the slides 2 and 2' at different elevations around each of the ink cartridges 11 and 11'. The slides 2 and 2' are respectively and fixedly secured to the ink cartridges 11 and 11' by a respective pair of locating rings 25 and 25'. Each of the slides 2 and 2' has two lugs, namely, the upper lug 23 and the lower lug 24 disposed at different elevations and facing the longitudinal central axis of the barrel 1. The upper lug 23 has a top side sloping downwardly toward the longitudinal central axis of the barrel 1. The lower lug 24 has a bottom side sloping upwardly toward the longitudinal central axis of the barrel 1. The lower lug 24 has a bottom side sloping upwardly toward the longitudinal central axis of the barrel 1. A plurality of elongated sliding slots 13 and 13' corresponds to the number of the ink cartridges 11 and 11' and the number of the slides 2 and 2'. Each of the sliding slots 13 and 13' has a bottom end terminating in an expanded, tapered hole 14. A locating board 15 is transversely mounted inside the barrel 1 in front of the sliding slots 13 and 13', having a plurality of through holes 150 for passing the ink cartridges 11 and 11' respectively. The aforesaid bottom springs 26 are respectively mounted around the ink cartridges 11 and 11' and stopped between the locating board 15 and the slides 2 and 2'. Therefore, the bottom springs 26 can be compressed by the slides 2 and 2' respectively. Each of the slides 2 and 2' further comprises a driving arm 21 terminating in a rounded end 210. The rounded end 210 of each of the slides 2 and 2' is disposed outside one sliding slot 13.

Figure 3:
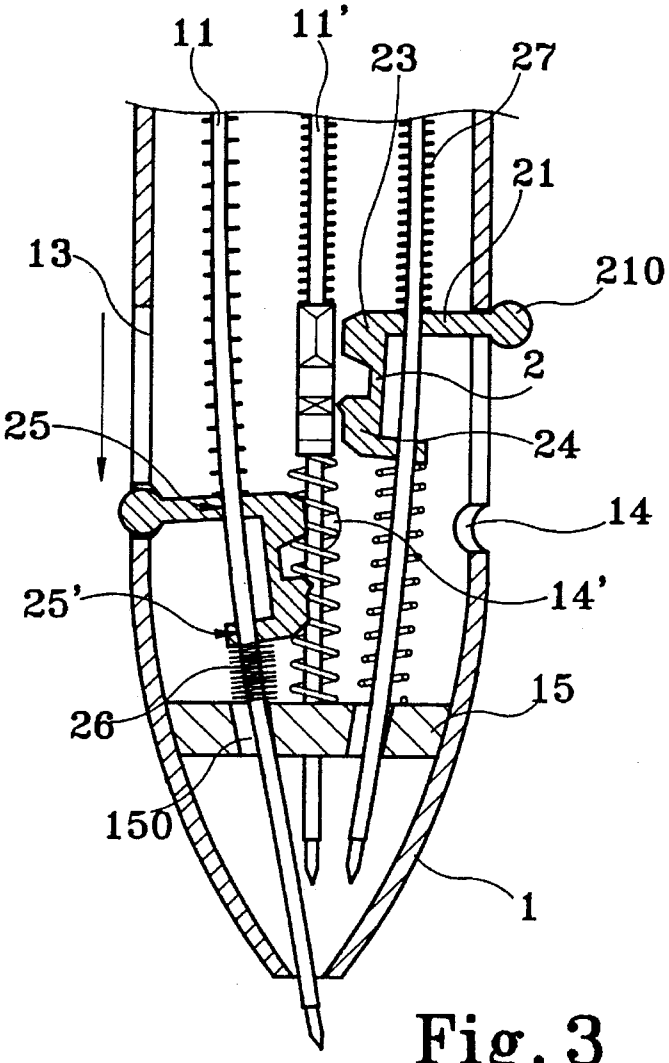
FIG. 3 is similar to FIG. 2 but showing one ink cartridge moved to the extended position and locked.

FIG. 3 shows one ink cartridge 11 moved to the extended position for writing. The respective bottom spring 26 is compressed, and the rounded end 210 of the driving arm 21 of the respective slide 2 is forced into engagement with the expanded, tapered hole 14 of the respective sliding slot 13. Because the ink cartridges are bendable, they can be deformed and forced out of the front end of the barrel 1 when the respective slides 2 are moved downwards.

Figure 4:
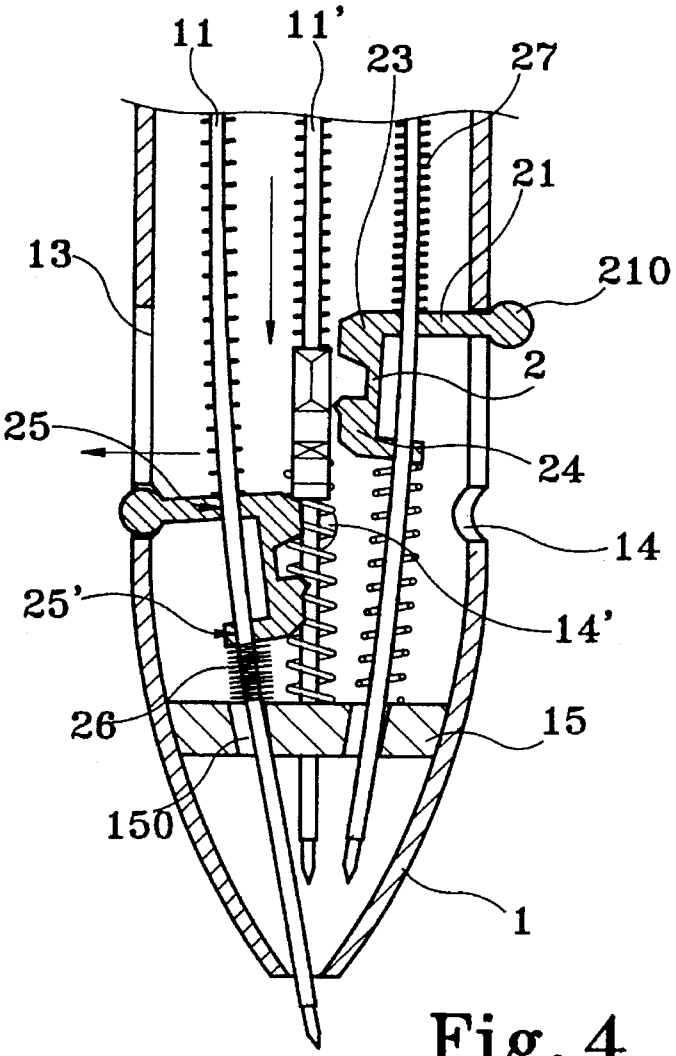
FIG. 4 is similar to FIG. 3 but showing the slide of a second ink cartridge moved downwards, and the slide of the extended first ink cartridge forced outwards from the locking position to the unlocking position.

Referring to FIG. 4, when the rounded end 210 of the driving arm 21 of a second slide 2' is moved downwards, the corresponding ink cartridge 11' is carried downwards. At the same time the bottom lug 24' of the second slide 2' is forced against the upper lug 23 of the slide 2 of the extended ink cartridge 11, causing the slide 2 to move outwards, and therefore the rounded end 210 of the slide 2 is released from the expanded, tapered hole 14 of the respective sliding slot 13. When rounded end 210 of the slide 2 is released from the expanded, tapered hole 14 of the respective sliding slot 13, the corresponding bottom spring 26 immediately returns to its former shape to push the slide 2 to its former shape to push the slide 2 to its former (upper limit) position. Therefore, the ink cartridge 11 is returned from the extended position to the retracted position, and the ink cartridge 11' is moved to from the retracted position to the extended position. When the ink cartridge 11' is moved to the extended position, the rounded end 210 of the slide 2' is forced into engagement with the expanded, tapered hole 145 of the respective sliding slot 13 to lock the ink cartridge 11' in the operative position.

I claim:

1. An ink cartridge selection control mechanism for a writing apparatus having an elongated barrel with a lower, writing end and an upper end, and a plurality of ink cartridges each having a writing end portion and movable between retracted and extended positions, the control mechanism comprising:

a) a locating board mounted in the elongated barrel adjacent to the lower, writing end of the barrel, the locating board having a plurality of through holes each having a writing end portion of an ink cartridge extending therethrough, the through holes located so as to form the writing end portion of each cartridge into a curved configuration;

b) a plurality of slots in the elongated barrel adjacent to the lower, writing end of the barrel, each slot having a lower end terminating with an enlarged, tapered hole;

c) a slide fixedly attached to each ink cartridge at the curved end portion, each slide having spaced apart tapered upper and tapered lower lugs facing a longitudinal axis of the elongated barrel, a driving arm extending through one of the plurality of slots, each driving arm having an enlarged end disposed externally of the elongated barrel; and, d) a spring mounted around each of the plurality of ink cartridges and extending between the locating board and the associated slide so as to bias the cartridge toward its retracted position;

wherein when a first ink cartridge is moved to the extended position by the respective first slide, the respective spring is compressed, and the enlarged end of the associated driving arm of the respective slide is forced into engagement with the enlarged, tapered hole of the respective slot by the curvature of the writing end portion of the ink cartridge to lock the first ink cartridge in the extended position; and, when a second ink cartridge is moved by the respective second slide toward the extended position, the first slide of the extended first ink cartridge is forced outwards by contact between the tapered lugs of the first and second slides to release the enlarged end of the respective driving arm from the enlarged, tapered hole of the respective slot, thereby enabling the respective spring to push the first slide and first cartridge to the retracted position.

* * * * *